US005344010A

United States Patent [19]

Dyer et al.

[11] Patent Number: 5,344,010

[45] Date of Patent: Sep. 6, 1994

[54] HAND GUN CASE WITH LOCK AND BLOCK

[75] Inventors: Arthur J. Dyer; Tommie L. Crawford, both of McMinnville; Kenneth L. Beaty, Readyville; Charles E. Morgan, Rock Island; Garry D. Mooneyham, Woodbury; Alton L. Monneyham, McMinnville; Charlie F. Watts, Hermitage, all of Tenn.

[73] Assignee: Metal Products Company, McMinnville, Tenn.

[21] Appl. No.: 40,124

[22] Filed: Mar. 30, 1993

[51] Int. Cl.[5] ..... B65D 85/00; B65D 55/14

[52] U.S. Cl. ..... 206/317; 70/63; 70/159; 206/1.5

[58] Field of Search ..... 70/63, 159–162, 70/416, 417; 206/1.8, 317; 109/51, 52, 68

[56] References Cited

U.S. PATENT DOCUMENTS

| | | | |
|---|---|---|---|
| 2,494,942 | 1/1950 | Hirsch | 206/1.5 |
| 3,215,262 | 11/1965 | Fernandez et al. | 206/1.5 |
| 3,954,172 | 5/1976 | Rinella | 206/1.5 |
| 4,290,281 | 9/1981 | Knaack et al. | 70/159 X |
| 4,348,967 | 9/1982 | Schattner et al. | 109/51 |
| 4,474,116 | 10/1984 | Castenada, Jr. et al. | 70/63 X |
| 4,890,466 | 1/1990 | Cislo | 70/63 |
| 5,009,088 | 4/1991 | Cislo | 70/63 |
| 5,168,994 | 12/1992 | Beletsky et al. | 206/317 |

OTHER PUBLICATIONS

Enlarged Photograph of MPC Handgun Case May 1993 "Gun Tests".

Report from the May 1993 "Gun Tests".

*Primary Examiner*—Bryon P. Gehman

*Attorney, Agent, or Firm*—Edward D. Lanquist, Jr.; Mark J. Patterson; I. C. Waddey, Jr.

[57] ABSTRACT

The present invention discloses a hand gun case having a top section hingedly attached to a bottom section. Into the top section there is placed a top insert that supports the front and two sides of the top section against prying and also has an additional guide through which the bolt of the lock is directed. A lock is attached proximate to the front of the top section. A bottom insert is placed into the bottom section which has a block which aligns underneath the lock when the top section is in a closed position. The bottom section also has a lock protection bar.

8 Claims, 3 Drawing Sheets

HAND GUN CASE WITH LOCK AND BLOCK

BACKGROUND OF THE INVENTION

The present invention relates generally to a hand gun case and more particularly to a hand gun case which can be locked to prevent unauthorized entry.

It will be appreciated by those skilled in the art that many states now have laws which require that a hand gun must be stored in a locked position to prevent injury by minors and others. It will further be appreciated by those skilled in the art that the many states have laws which require that the owner of a hand gun is responsible for all damage and injury caused by unauthorized use of a hand gun. To this end, there have been several attempts to design cases which prevent unauthorized access to a hand gun.

Many of these cases are made of steel having a hinge in which the top section is locked to the bottom section. Unfortunately, in those cases in which the lock is placed on the top section, the cases are accessible by pounding the lock downwardly into the space between the upper section and the lower section. Further, these cases are also susceptible to having the top section pried away from the bottom section at the edges of the top section. Also, the bracket into which the bolt goes tends to be very easy to break or bend on these earlier cases.

What is needed, then, is a gun case which has a top section secured to a bottom section by a strong hinge. This needed gun case must make prying the sides of the top away from the bottom difficult. This device must prevent one from driving the lock downwardly into the space between the top section and the bottom section. This device must reduce the ability of an individual attempting to gain unauthorized access into the case of breaking the guide into which the bolt of the lock is placed. This device is presently lacking in the prior art.

SUMMARY OF THE INVENTION

The present invention discloses a hand gun case having a top section hingedly attached to a bottom section. Into the top section there is placed a top insert that supports the front and two sides of the top section against prying and also has an additional guide through which the bolt of the lock is directed. A lock is attached proximate to the front of the top section. A bottom insert is placed into the bottom section which has a block which aligns underneath the lock when the top section is in a closed position. The bottom section also has a lock protection bar.

Accordingly, one object of the present invention is to provide a hand gun case which decreases the access to an unauthorized person.

Still another object of the present invention is to provide a case which decreases the ability of an individual to pry up the sides or the front.

Still another object of the present invention is to provide a case which prevents one from driving the lock downwardly into the space between the top section and the bottom section.

DESCRIPTION OF THE PREFERRED EMBODIMENT

Figure 1:
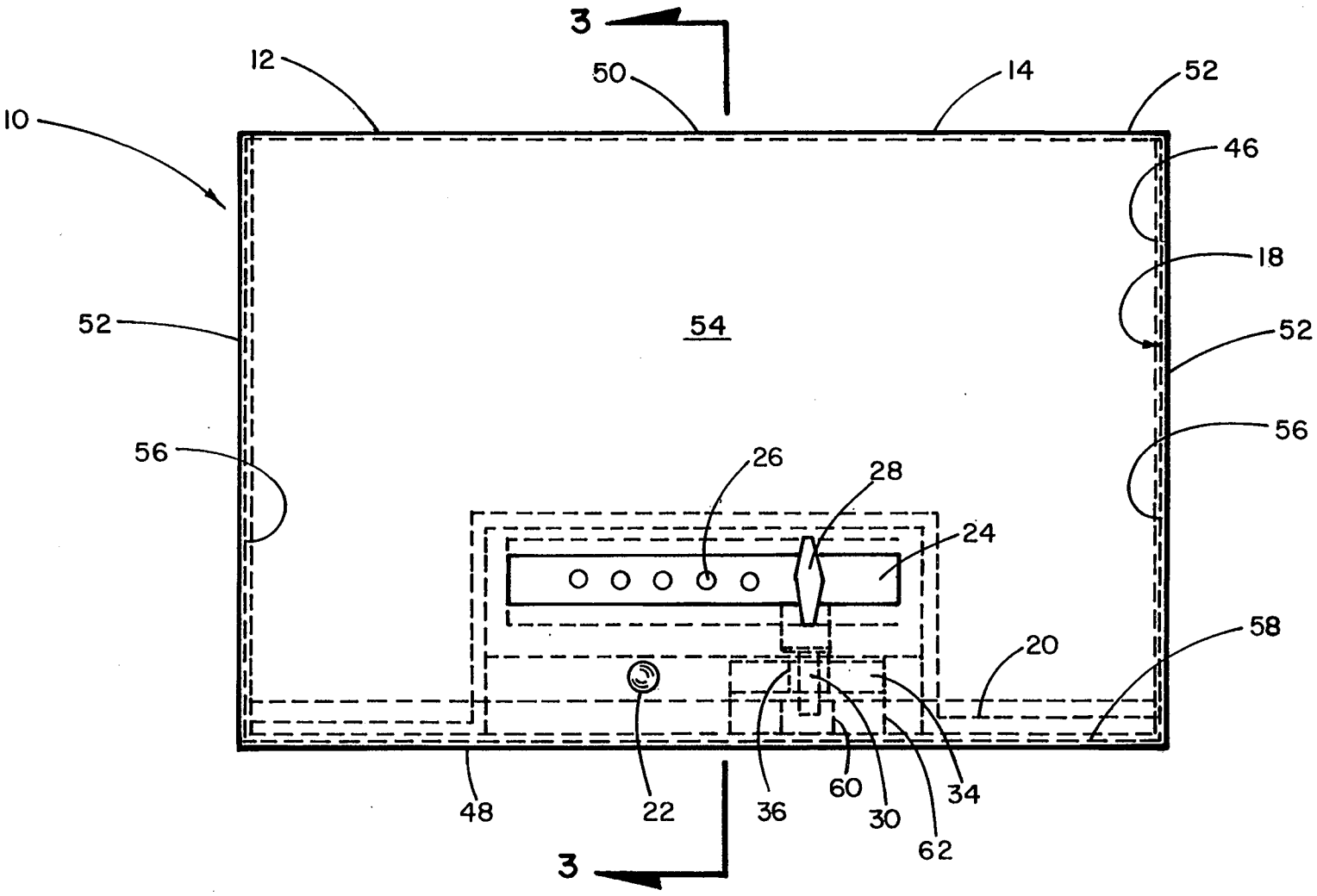
FIG. 1 is a plan view of the hand gun case of the present invention.
Figure 2:
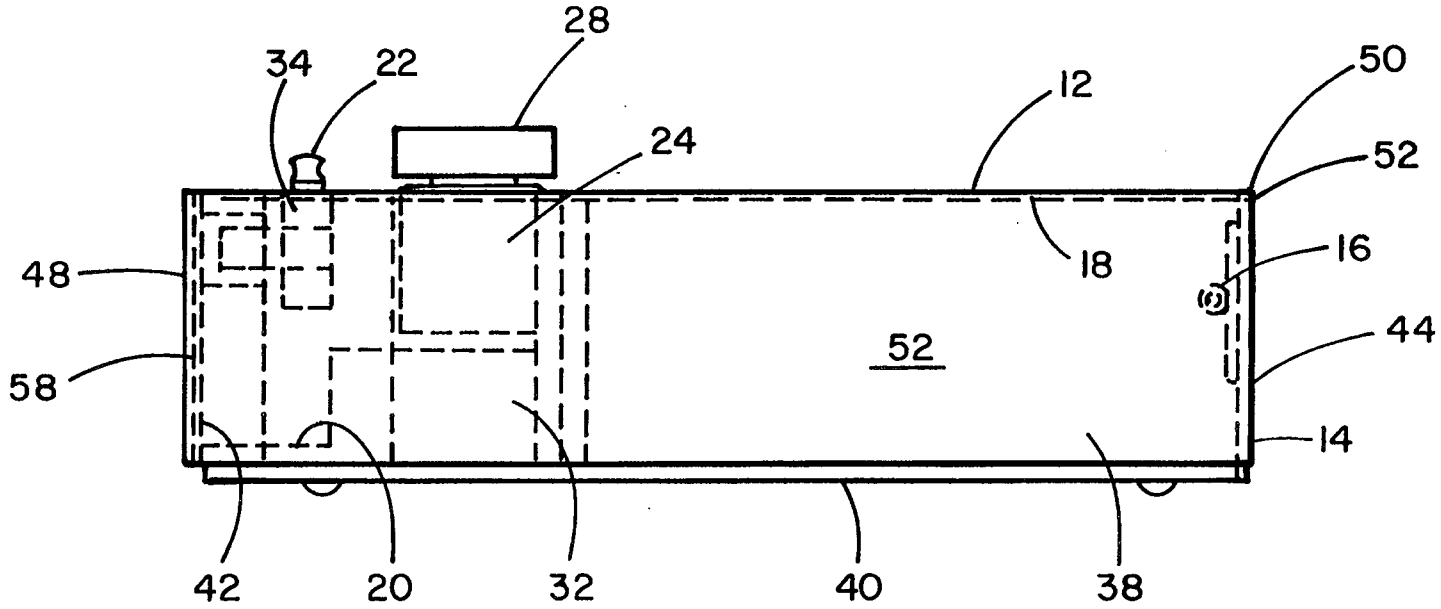
FIG. 2 is an end view of the hand gun case of the present invention.
Figure 3:
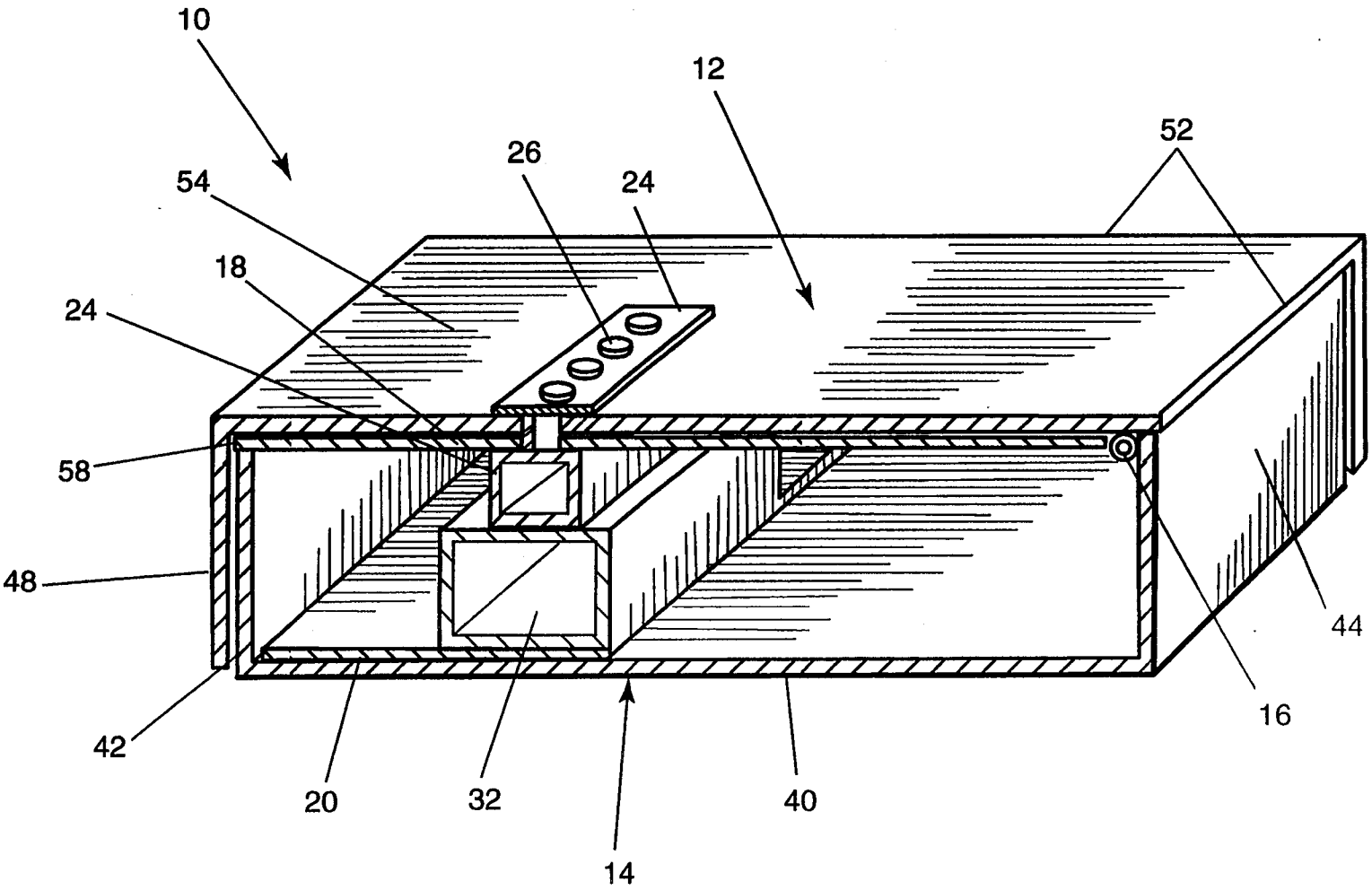
FIG. 3 is a side cutaway along line 3—3 in FIG. 1.

Referring now to FIGS. 1, 2 and 3, there is shown generally at 10 the hand gun case of the present invention. Case 10 has top section 12 joined to bottom section 14 by hinge 16. Bottom section 14 has base 40. Rising substantially perpendicular from base 40 is front 42 and back 44. Joining front 42 and back 44 are sides 46. Bottom section also has lock protection bracket 62 attached proximate front 42. Bracket 62 has hole or bolt rest 60 placed through it.

Top section 12 has forward section 48 and rearward section 50 attached to top 54. Joining forward section 48 and rearward section 50 are edges 52. Top section 12 also has top bracket 34 attached proximate to forward section 48. Bracket 34 has orifice or bolt guide 36 placed through it.

Received by and attached to top section 12 is top insert 18. Top insert 18, in the preferred embodiment, has sides supports 56 and front support 58.

Lock 24 attaches to top section 12, in the preferred embodiment, proximate to forward section 48. Lock 24 is inserted into top section 12. Lock 24 has combination buttons 26 and key 28 in the preferred embodiment as well as bolt 30 which extends into bolt guide 36 and into bolt rest 60. In the preferred embodiment, lock 24 is a Simplex lock.

Bottom insert 20 rest is received by and attaches to bottom section 14 proximate to front 42. Bottom insert 20 has block 32 which resides, when top section is in closed position, proximate to lock 24. Block 32 prevents an individual from driving lock 24 into the ordinarily empty space between top section 12 and bottom section 14.

In the preferred embodiment, hand gun case 10 is made of stainless steel. In the preferred embodiment, lock 24 is a Simplex TM push button lock. Two foam pads are provided, one attached to top section 12 and another attached to bottom section 14.

Top section 12 is made of, in the preferred embodiment, sixteen gauge 304 stainless steel with holes punched into it to accept lock 24. In the preferred embodiment, all four corners are welded and ground smooth to provide an aesthetically pleasing appearance. In the preferred embodiment, forward section 48 and edges 52 are reinforced with top insert 18 to reduce the chance that an object can pry open the welded comers of top section 12. Top section 12 has bolt guide which is, in the preferred embodiment, made of a 0.375 inch×1 inch stainless steel bar which is welded into place. Top section 12 also can have knob 22 which is brass which eases lifting.

Bottom section 14 is made of sixteen gauge stainless steel. In the preferred embodiment, all four corners are welded with a sixteen gauge stainless steel lock protection bracket 62 provided for additional support for bolt 30.

In the preferred embodiment, bottom insert 20 is also made of stainless steel and has block 32 which is welded in place. Insert 20 forms a corral around the area where lock 24 goes when top section 12 is in a closed position. Block 32 prevents someone from driving lock 24 downwardly.

Additionally, attached to bottom section 14 there is lock protection bracket 62 having hole or bolt rest 60. Bracket 62 is, in the preferred embodiment, made of 0.357 inch×1 inch stainless steel bar welded into place.

Attached to top section 12 there is bracket 34 having bolt guide orifice 36. Bracket 34 is, in the preferred embodiment, made of 0.357 inch × 1 inch stainless steel bar welded into place.

In the preferred embodiment, hinge 16 is made of 0.062 inch thick stainless steel and is 1.5 inches wide and 11.688 inches long. Hinge 16 is attached to bottom section 14 and top section 12 by 10–24 stainless steel carriage bolts and 10–24 stainless steel lock nuts.

Thus, although there have been described particular embodiments of the present invention of a new and useful hand gun case, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What is claimed is:

1. A case for preventing unauthorized access to a firearm comprising:

a. a bottom section having a base, a front and a back attached to said base, and two sides attached to said base, said front, and said back;

b. a top section having a forward section, a rearward section, and two edges joining a forward section to a rearward section, said top section proximate said rearward section joined to said bottom section by a hinge;

c. a top insert received by and attached to said top section for reinforcing said edges and said forward section of said top section;

d. a lock attached to said top section and said top insert; and e. a bottom insert received by and attached to said bottom section, said bottom section having a block attached to said bottom insert so that it aligns proximate said lock when said top section is in a closed position.

2. The case of claim 1 wherein:

a. said lock comprises a bolt; and b. said top section having a bolt guide.

3. A case for preventing unauthorized access to a firearm comprising:

a. a bottom section;

b. a top section hingedly attached to said bottom section;

c. a lock attached to said top section proximate said forward section; and d. a block attached to said bottom section so that it aligns proximate said lock when said top section is in a closed position.

4. The case of claim 3 wherein said bottom section having a base, a front and a back attached to said base, and two sides attached to said base, said front, and said back.

5. The case of claim 3 wherein said top section having a forward section, a rearward section, and two edges joining said forward section to said rearward section, said top section proximate said rearward section joined to said bottom section by a hinge.

6. The case of claim 3 further comprising a top insert received by and attached to said top section for reinforcing said top section.

7. The case of claim 3 further comprising a bottom insert received by and attached to said bottom section, said bottom section having said block.

8. The case of claim 3 wherein:

a. said lock comprises a bolt; and b. said top section having a bolt guide.

* * * * *